US008230773B2

(12) United States Patent
Schwarzkopf

(10) Patent No.: US 8,230,773 B2
(45) Date of Patent: Jul. 31, 2012

(54) AXIAL PISTON COMPRESSOR, IN PARTICULAR A COMPRESSOR FOR THE AIR CONDITIONING SYSTEM OF A MOTOR VEHICLE

(75) Inventor: Otfried Schwarzkopf, Kuerten (DE)

(73) Assignee: Valeo Compressor Europe GmbH (DE)

( * ) Notice: Subject to any disclaimer, the term of this patent is extended or adjusted under 35 U.S.C. 154(b) by 1236 days.

(21) Appl. No.: 11/629,392

(22) PCT Filed: Jun. 6, 2005

(86) PCT No.: PCT/EP2005/006059

§ 371 (c)(1),
(2), (4) Date: Nov. 13, 2007

(87) PCT Pub. No.: WO2005/124150

PCT Pub. Date: Dec. 29, 2005

(65) Prior Publication Data

US 2011/0164994 A1 Jul. 7, 2011

(30) Foreign Application Priority Data

Jun. 16, 2004 (DE) ..... 10 2004 029 021

(51) Int. Cl.
*F01B 13/04* (2006.01)
*F01B 3/00* (2006.01)

(52) U.S. Cl. ..... 92/12.2; 92/71; 91/505

(58) Field of Classification Search ..... 91/499, 91/504, 505, 506; 92/12.2, 71; 417/222.2, 417/269

See application file for complete search history.

(56) References Cited

U.S. PATENT DOCUMENTS 5,063,829 A * 11/1991 Takao et al. ..... 92/71
6,139,282 A * 10/2000 Ota et al. ..... 417/222.2
2001/0029837 A1* 10/2001 Kayukawa et al. ..... 92/71

FOREIGN PATENT DOCUMENTS

DE 198 08 256 2/1997

(Continued)

OTHER PUBLICATIONS

German Search Report dated Dec. 20, 2004.

*Primary Examiner* — Michael Leslie
(74) *Attorney, Agent, or Firm* — Andrus, Sceales, Starke & Sawall, LLP

(57) ABSTRACT

Axial piston compressor, especially a compressor for the air-conditioning system of a motor vehicle, having a housing and, for drawing in and compressing a coolant, a compressor unit arranged in the housing and driven by means of a drive shaft, the compressor unit comprising pistons, which move axially back and forth in a cylinder block, and a tilt plate 10 (tilt ring; wobble plate or swash plate), which drives the pistons and rotates together with the drive shaft, wherein the tilt plate 10 or a tiltable part thereof associated therewith has locations 14, 15 of reduced amassing of material and/or locations which consist of a material which is different from the material from which the rest of the tilt plate 10 or tiltable part thereof is made, those locations bringing about a specific effect on the regulation behavior of the compressor in such a way that in a region of small tilt angles of the tilt plate 10 or tiltable part thereof, especially in a tilt angle range from 0° to 8°, especially 0° to 3°, a moment directed to a very large extent in the same direction as an advancing moment of the tilt plate 10 is achieved so that the tilt moment of the tilt plate 10 in the afore-mentioned tilt angle range is increased (accelerated up-regulation of the compressor).

17 Claims, 12 Drawing Sheets

FOREIGN PATENT DOCUMENTS

| | | |
|---|---|---|
| DE | 197 49 727 | 11/1997 |
| DE | 198 39 914 | 9/1998 |
| EP | 0 809 027 | 11/1997 |
| EP | 1 148 239 | 10/2001 |
| EP | 1 713 557 | 1/2002 |

* cited by examiner

AXIAL PISTON COMPRESSOR, IN PARTICULAR A COMPRESSOR FOR THE AIR CONDITIONING SYSTEM OF A MOTOR VEHICLE

CROSS REFERENCE TO RELATED APPLICATION

The present application claims priority from German Patent Application No. 10 2004 029 021.0 filed Jun. 16, 2004.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

The invention relates to an axial piston compressor, especially a compressor for the air-conditioning system of a motor vehicle, having a housing and, for drawing in and compressing a coolant, a compressor unit arranged in the housing and driven by means of a drive shaft, the compressor unit comprising pistons, which move axially back and forth in a cylinder block, and a tilt plate, for example in the form of tilt ring, wobble plate or swash plate, which drives the pistons and rotates together with the drive shaft.

An axial piston compressor of such a kind is known, for example, from DE 197 49 727 A1. That compressor comprises a housing in which, in a circular arrangement, a plurality of axial pistons are arranged around a rotating drive shaft. The drive force is transmitted from the drive shaft, by way of a member for conjoint movement, to an annular tilt plate and in turn, from there, to the pistons displaceable in translation parallel to the drive shaft. The annular tilt plate is pivotally mounted on a sleeve which is mounted on the drive shaft so as to be axially displaceable. In the sleeve there is provided an elongate hole, through which the mentioned member for conjoint movement engages. Consequently, the capability of the sleeve for axial movement on the drive shaft is limited by the dimensions of the elongate hole. Assembly is carried out by passing the member for conjoint movement through the elongate hole. The drive shaft, member for conjoint movement, sliding sleeve and tilt plate are arranged in a so-called drive mechanism chamber, in which gaseous working medium of the compressor is present at a particular pressure. The delivery volume and consequently the delivery output of the compressor are dependent on the pressure ratio between the suction side and delivery side of the pistons or correspondingly dependent on the pressures in the cylinders on the one hand and in the drive mechanism chamber on the other hand.

A somewhat different kind of construction of an axial piston compressor is described, for example, in DE 198 39 914 A1. The tilt plate is in the form of a wobble plate, there being arranged between the wobble plate and the pistons a non-rotating take-up plate mounted opposite the wobble plate.

The compressor shown in FIG. 13 is known from EP 1 172 557 A2. That compressor has a tilt plate arrangement having a tilt plate in the form of a swash plate 118, with which the pistons 120 are in articulated connection by way of sliding blocks 121. The tilt plate arrangement also has a supporting arrangement which simultaneously, in the form of a part for conjoint movement, transmits torque between a drive shaft 114 and the swash plate 118.

A first component for conjoint movement 117, which is fixed to the drive shaft 114 and is arranged as a bearing, in the form of a receiving bore, for the part for conjoint movement is disposed a substantial distance to the side of the swash plate 118, and a second component for conjoint movement 119, which engages in the first in a manner allowing articulation, is in the form of a lateral extension to the swash plate 118. The above-described structure of the swash plate in the form of the components for conjoint movement 117 and 119, which are present as pairs, causes the swash plate arrangement to have an outwardly displaced centre of gravity. The centre of gravity's being remote from the tilt axis and also from the tilt-providing articulation gives rise to an imbalance because the drive mechanism can be balanced only for a preferably medium tilt angle of the swash plate. It is to be noted that the centre of gravity moves in dependence on the tilt angle at a considerable distance from the tilt-providing articulation, which represents the centre of the tilt movement. The swash plate 118 furthermore has a thickened hub portion and has, as explained above, a relatively large moment of inertia due to the components for conjoint movement 117 and 119 together with a centre of gravity which is far removed from the tilt axis so that a sudden change in the speed of rotation results in adjustment of the inclination of the swash plate 118 with corresponding inertia.

The location of the centre of gravity also plays an important part in governing regulation behaviour. The regulation behaviour is influenced in such a way that the compressor undergoes a high degree of up-regulation, that is to say the mass forces of inertia of the swash plate and the location of its centre of gravity give rise to a moment of deviation J, which in turn generates a tilt moment $M_{SW}=J\times\omega^2$. The afore-mentioned tilt moment always opposes the moment of deviation J. This generally means, in the case of compressors according to the prior art, a reduction in tilt angle, especially in the working range at medium and larger tilt angles. Of course, various moments of deviation generally act on a component, the moment of deviation mentioned here being the moment of deviation that is relevant to the tilt movement of the swash plate. This moment of deviation is caused by the sole degree of freedom present in the system, which degree of freedom is due to the tilt-providing articulation.

An arrangement like that described above is put into practice, for example, in the mass-produced compressor 6SEU 12 C of DENSO, in which R134a is used as coolant. The (relevant) moment of deviation J of the swash plate gives rise to a tilt moment $M_{SW}$ about the centre of the tilt movement of the swash plate which has an effect, at least in the region of medium and larger swash plate tilt angles, such that the tilt angle of the swash plate tries to decrease. The mass forces of the pistons give rise (by way of their excursion) to a tilt moment $M_{k,ges}$ at the swash plate which is likewise applied about the centre of the tilt movement of the swash plate. In contrast to the tilt moment $M_{SW}$ of the swash plate, the tilt moment produced by the pistons has an effect in the direction of an increase in the tilt angle of the swash plate. The mass centre of gravity of the system, which is located outside the tilt point or point of rotation of the swash plate, reinforces the effect of the pistons. The effect brought about by the centre of gravity is generally a contributing factor in calculation of the (total) moment of deviation, where it is taken into account by means of a so-called Steiner component.

In relation to the mentioned 6SEU 12 C compressor of DENSO, it is to be noted that the mass of a tilt plate cannot be increased at will in order to modify the regulation behaviour accordingly. This is due to the fact that, in the case of the compressors of the described kind, the mass centre of gravity of the tilt plate is generally a substantial distance away from the tilt-providing articulation of the tilt plate. The basic justification for such an arrangement is that the tilt plate, in addition to its own guideway on the drive shaft, has to be coupled, by way of a positioning mechanism, to the drive shaft or a component connected to the drive shaft (component for conjoint movement).

The mentioned distance between the centre of gravity of the tilt plate and the tilt-providing articulation thereof results in imbalance of the drive mechanism, especially in dependence upon the tilt angle of the tilt plate (the centre of gravity moves "in the manner of a swing" beneath the tilt-providing articulation), and in the worst case results in an up-regulating characteristic (so-called "location of centre of gravity").

Future compressors should not have, in the region of the tilt plate, an outwardly displaced location of centre of gravity, and the imbalance due to the drive mechanism, which is brought about especially by the tilt plate, should be small or, ideally, zero.

Generally it is the following moments which in the centre of the tilt movement of the tilt plate have an influence on the tilting of the tilt plate. The direction of the moment is given in brackets, with (−) denoting down-regulation (in the direction of minimum stroke) and (+) denoting up-regulation (in the direction of maximum stroke):

- moment due to gas forces in the cylinder spaces (+)
- moment due to gas forces from the drive mechanism chamber (−)
- moment due to a restoring spring (−)
- moment due to an advancing spring (+)
- moment due to rotating masses (−); including moment due to location of centre of gravity (for example, tilt plate: tilt location≠mass centre of gravity): can be (+) or (−)
- moment due to masses moved in translation (+)

In the case of changes in the speed of rotation and, at the same time, substantially constant operating conditions, it is only the last two mentioned moments, namely the moment due to rotating masses and the moment due to masses moved in translation, which affect the regulation behaviour. In this context what is decisive is, especially, the net result of the forces and moments about the centre of the tilt movement of the tilt plate.

In the case of compressors of modern design, it is desirable to provide an up-regulating moment in the region of small tilt angles of the tilt plate, whereas at medium and larger tilt angles a markedly down-regulating moment is favoured for the tilt plate.

In this context, reference is to be made to EP 0 809 027, in which it is pointed out that it is desirable in the case of compressors to provide constant regulation of the delivery quantity. In the afore-mentioned publication it is proposed that the kinematics of a compressor be so designed that the down-regulating tilting moments acting on the tilt plate of the compressor should clearly predominate over the up-regulating tilting moments.

In this context it should be mentioned that the phrase "delivery quantity" is relatively imprecise. The delivery quantity could be considered constant if, for example, on doubling the speed of rotation, the tilt angle of the tilt plate halves. As a result the delivery quantity would be constant in geometric terms. Of course, other parameters will also then have an effect on the delivery quantity when the tilt angle of the tilt plate changes, for example volumetric efficiency, oil throw-off or the like.

For constant regulation of the delivery quantity in the event of changing speeds of rotation, the restoring torque of the tilt plate is utilised because the tilt plate opposes its angled position because of the dynamic forces at the co-rotating plate part. This process can be aided by the force of a spring so that the increasing quantity delivered in the case of an increase in the speed of rotation is at least partly compensated by restoration of the angled or pivoted position of the tilt plate.

For a better understanding, the described tilting behaviour due to variation in the speed of rotation is shown in FIGS. 1 and 2. FIG. 1 shows the dependence of drive mechanism chamber pressure difference, relative to the suction pressure, set against the tilt angle α, or "alpha", of the tilt plate. Calculations were carried out by way of example for the following pressures:

high pressure 120 bar and suction pressure 35 bar.

Also calculations were carried out using the speeds of rotation:

600 rpm, 1200 rpm, 2500 rpm, 5000 rpm, 8000 rpm and 11,000 rpm.

In FIG. 1, however, only five of the six plots calculated are to be seen. This is due to the fact that the plots for the speeds of rotation 600 rpm and 1200 rpm lie substantially entirely on top of one another (because of a lacking dynamic); accordingly the "delivered quantity that is independent of the speed of rotation", which is required in the prior art, is rather a wishful notion that cannot be put into practice using the measures described.

Referring to the diagram according to FIG. 1, it can be very clearly seen that plots are obtained which cause the tilt plate to adopt greater tilt angles when the speed of rotation increases. In this context it should be mentioned that FIG. 1 is to be regarded only as an example using a simple geometry. However, the trend shown also applies to more complex geometries. The calculation was based on a tilt ring having a predetermined internal and external diameter and a predetermined height.

Also of relevance are the piston mass, the reference diameter on which the pistons are located, and the number of pistons.

The tilt ring preferably has a mass moment of inertia $J_2=J\eta$ or $J=m/4\ (r_a^2 r_i^2+h^2/3)$ which is greater than 100,000 $gmm^2$. Preferably, the mass moment of inertia is greater than J=200,000-250,000 $gmm^2$.

Furthermore, the tilt ring preferably has a mass moment of inertia of $$J_3 = J_\zeta = \frac{m}{2}(r_a^2 + r_i^2)$$

which is greater than 200,000 $gmm^2$, preferably about 400,000-500,000 $gmm^2$.

There is described hereinbelow the derivation of the so-called moment of deviation, which governs the tilting of the tilt plate or tilt ring and which, more particularly, in the case shown is solely responsible for the tilting of the tilt plate or tilt ring provided that the mass centre of gravity of the tilt plate or tilt ring is located both at the tilting point and also at the geometric centre-point of the tilt plate or tilt ring. This represents an ideal case of the arrangement that is to be aspired to. For the derivation of the moment of deviation the following very generally applies, with reference to FIG. 3:

$$J_{yz}=-J_1 \cos\alpha_2 \cos\alpha_3 - J_2 \cos\beta_2 \cos\beta_3 - J_3 \cos\gamma_2 \cos\gamma_3$$

$\alpha_1=0$ Direction angles of the x axis $\beta_1=90°$ relative to the main inertia axes $\xi\cdot\eta\cdot\zeta$ $\gamma_1=90°$ $\alpha_2=90°$ $\beta_2=\psi$Direction angles of the y axis $\gamma_2=90°+\psi$ relative to the main inertia axes $\xi\cdot\eta\cdot\zeta$
$\alpha_3=90°$ Direction angles of the z axis
$\beta_3=90°-\psi$ relative to the main inertia axes $\xi\cdot\eta\cdot\zeta\gamma_3\psi$ $$J_2 = J_\eta = \frac{m}{4}\left(r_a^2 + r_i^2 + \frac{h^2}{3}\right)$$

$$J_3 = J_\zeta = \frac{m}{2}(r_a^2 + r_i^2)$$

(Note: $J_3 \approx 2\ J_2$
Aim: $J_{yz}$ should have a particular magnitude
$J_{yz}\uparrow \nmid J_3\uparrow J_2$ necessarily increases!)
Moment of Deviation $$J_{yz}=-J_z \cos\psi \sin\psi + J_3 \cos\psi \sin\psi$$

The following holds true independently of FIG. 3:
Moment Due to Mass Force of the Pistons $$\beta_i = \theta + 2\pi(i-1)\frac{1}{n}$$

$$Zi=R\cdot\omega^2 \tan\alpha \cos\beta_i$$

$$F_{mi}=m_k\cdot z_i$$

$$M(F_{mi})=m_k\cdot R\cdot\cos\beta_i\cdot z_i$$

$$M_{k,ges} = m_k \cdot R\sum_{i=1}^{n} z_i \cdot \cos\beta_i$$

Moment Msw Due to Moment of Deviation $$M_{SW}=J_{yz}\cdot\omega^2$$

$$J_{yz} = \left\{\frac{msw}{2}(r_a^2 + r_i^2) - \frac{msw}{4}\left(r_2^2 + r_i^2 + \frac{h^2}{3}\right)\right\}\cos\alpha\sin\alpha$$

-continued $$J_{yz} = \frac{msw}{24}\sin 2\alpha(3r_a^2 + 3r_i^2 - h^2)$$

$$M_{SW} \geqq M_{k,ges}$$

or $$\left[\omega^2 R^2 \cdot m_k \tan\alpha \sum_{i=1}^{n} \cos^2\beta \leqq \omega^2 \frac{msw}{24}\sin 2\alpha(3r_a^2 + 3r_i^2 - h^2)\right]$$

The variables used above have the following meanings:

- θ rotation angle of the shaft (the considerations above and below being made on the basis of θ=0 for the sake of simplicity)
- η number of pistons
- R distance from piston axis to shaft axis
- ω speed of rotation of shaft
- α tilt angle of tilt ring/tilt plate
- mk mass of a piston including sliding blocks or pair of sliding blocks
- mk,ges mass of all pistons including sliding blocks
- msw mass of tilt ring
- ra external radius of tilt ring
- ri internal radius of tilt ring
- h height of tilt ring
- ρ density of tilt ring
- V volume of tilt ring
- βi angle position of piston i
- zi acceleration of piston i
- Fmi mass force of piston i (including a pair of sliding blocks)
- M(Fmi) moment due to mass force of piston i
- Mk,ges moment due to mass force of all pistons
- Msw moment due to advancing moment of tilt ring/tilt plate or due to moment of deviation ($J_{yz}$)
- J=f(ρ, r, h) mass moment of inertia Specifically, FIG. 1 was based on the following tilt plate or swash plate tilt moment determination, wherein α was varied from 0° to 16°:

Determination of swash plate tilt moment

| | | | | | | | | | |
|---|---|---|---|---|---|---|---|---|---|
| theta | 0 | 0.00 | [*] | | | | | | |
| n (p) | 7 | | — | beta | i | | | Jz | 208436 |
| R | 29 | | [mm] | beta | 1 | 0.0 | 0.00 | | |
| n | 2500 | | [1/min] | beta | 2 | 51.4 | 0.90 | (jx =) Jy | 106137 |
| alpha | 16 | 0.28 | [*] | beta | 3 | 102.9 | 1.80 | | |
| mk | 45 | | [g] | beta | 4 | 154.3 | 2.69 | Jyz | 27105 |
| mk,ges | 315 | | [g] | beta | 5 | 205.7 | 3.59 | | |
| | | | | beta | 6 | 257.1 | 4.49 | omega | 262 |
| msw | 230 | | [g] | beta | 7 | 308.6 | 5.39 | | |
| ra | 37 | | [mm] | | | | | | |
| ri | 21 | | [mm] | | | | | | |
| h | 10 | | [mm] | z'' | i | | | Jy/mk,ges | 337 |
| | | | | z'' | 1 | 569.9 | | | |
| rho | 7.9 | | [g/cm³] | z'' | 2 | 355.4 | | Jy/msw | 461 |
| | | | | z'' | 3 | −126.8 | | | |
| | | | | z'' | 4 | −513.5 | | Jz/mk,ges | 662 |
| | | | | z'' | 5 | −513.5 | | | |

-continued

| Determination of swash plate tilt moment | | | | | | | | |
|---|---|---|---|---|---|---|---|---|
| | | | z" | 6 | −126.8 | | Jz/msw | 905 |
| V | 29154 | [mm³] | z" | 7 | 355.4 | | | |
| | | | | | | | msw/mk,ges | 0.73 |
| | | | Fmi | i | | | | |
| R fr,eing | 30 | | Fmi | 1 | 25.6 | | | |
| R f(ra:ri) | 29 | | Fmi | 2 | 16.0 | | | |
| | | | Fmi | 3 | −5.7 | | | |
| | | | Fmi | 4 | −23.1 | | | |
| | | | Fmi | 5 | −23.1 | | | |
| sin2(alpha | 0.5299 | | Fmi | 6 | −5.7 | | | |
| tan(alpha) | 0.2867 | | Fmi | 7 | 16.0 | | | |
| | | | M(Fmi) | i | | | | |
| | | | M(Fmi) | 1 | 0.74 | | | |
| | | | M(Fmi) | 2 | 0.29 | | | |
| | | | M(Fmi) | 3 | 0.04 | | | |
| | | | M(Fmi) | 4 | 0.60 | | | |
| | | | M(Fmi) | 5 | 0.60 | | | |
| | | | M(Fmi) | 6 | 0.04 | | | |
| | | | M(Fmi) | 7 | 0.29 | | | |
| n | 2500 | [1/min] | Mk,ges | | 2.6032 | | Msw | 1.8578 |
| alpha | 16 | [*] | | | | | | |

It can be seen that the influence of the piston masses predominates, resulting in up-regulation behaviour of the swash plate or tilt plate with increasing speed of rotation. In this case, therefore $M_{k,ges}>M_{SW}$.

FIG. 2 shows a diagram for an almost identical drive mechanism, which diagram results from the following calculation scheme, a being varied from 0° to 16° in this case too:

| Determination of swash plate tilt moment | | | | | | | | | |
|---|---|---|---|---|---|---|---|---|---|
| theta | 0 | 0.00 | [*] | | | | | | |
| n(p) | 7 | | — | beta | i | | | Jz | 375185 |
| R | 29 | | [mm] | beta | 1 | 0.0 | 0.0 | | |
| n | 2500 | | [1/min] | beta | 2 | 51.4 | 0.90 | (Jx =) Jy | 198786 |
| alpha | 16 | 0.28 | [*] | beta | 3 | 102.9 | 1.80 | | |
| mk | 45 | | [g] | beta | 4 | 154.3 | 2.69 | Jyz | 46739 |
| mk,ges | 315 | | [g] | beta | 5 | 205.7 | 3.59 | | |
| | | | | beta | 6 | 257.1 | 4.49 | omega | 262 |
| msw | 415 | | [g] | beta | 7 | 308.6 | 5.39 | | |
| ra | 37 | | [mm] | | | | | | |
| ri | 21 | | [mm] | | | | | | |
| h | 18 | | [mm] | z" | i | | | Jy/mk,ges | 631 |
| | | | | z" | 1 | 569.9 | | | |
| rho | 7.9 | | [g/cm³] | z" | 2 | 355.4 | | Jy/msw | 480 |
| | | | | z" | 3 | −126.8 | | | |
| | | | | z" | 4 | −513.5 | | Jz/mk,ges | 1191 |
| | | | | z" | 6 | −126.8 | | Jz/msw | 905 |
| V | 52477 | | [mm³] | z" | 7 | 355.4 | | | |
| | | | | | | | | msw/mk,ges | 1.32 |
| | | | | Fmi | i | | | | |
| R fr,eing | 30 | | | Fmi | 1 | 25.6 | | | |
| R f(ra:ri) | 29 | | | Fmi | 2 | 16.0 | | | |
| | | | | Fmi | 3 | −5.7 | | | |
| | | | | Fmi | 4 | −23.1 | | | |
| | | | | Fmi | 5 | −23.1 | | | |
| sin2(alpha | 0.5299 | | | Fmi | 6 | −5.7 | | | |
| tan(alpha) | 0.2867 | | | Fmi | 7 | 16.0 | | | |
| | | | | M(Fmi) | i | | | | |
| | | | | M(Fmi) | 1 | 0.74 | | | |
| | | | | M(Fmi) | 2 | 0.29 | | | |

-continued

| Determination of swash plate tilt moment | | | | | | | | |
|---|---|---|---|---|---|---|---|---|
| | | | M(Fmi) | 3 | 0.04 | | | |
| | | | M(Fmi) | 4 | 0.60 | | | |
| | | | M(Fmi) | 5 | 0.60 | | | |
| | | | M(Fmi) | 6 | 0.04 | | | |
| | | | M(Fmi) | 7 | 0.29 | | | |
| n | 2500 | [1/min] | Mk,ges | | 2.6032 | | Msw | 3.2034 |
| alpha | 16 | [*] | | | | | | |

In this case, $M_{k,ges}<M_{SW}$.

This calculation scheme shows that, compared to the calculation relating to FIG. 1, the thickness or height of the swash plate or tilt plate was increased from 10 mm (FIG. 1) to 18 mm (FIG. 2). The consequence thereof is that the relevant mass moment of inertia $J_z$ is increased to about twice its value in comparison. In FIG. 2, there can be seen down-regulation behaviour of the tilt plate drive mechanism. This tendency is indicated by the arrow "n" in FIG. 2, "n" meaning the speed of rotation of the tilt plate and drive shaft. The arrow "n" in FIG. 1 has, of course, the same meaning, but in that case the arrow points in the opposite direction, which is intended to indicate up-regulation with increasing speed of rotation.

FIG. 1 reflects the prior art. In that context, the up-regulation behaviour corresponding to FIG. 1 is frequently to be found in current mass-produced R134a compressors. In the case of more recent developments, on the other hand, attempts are being made to change this tendency to the opposite, namely to that corresponding to FIG. 2.

In FIG. 4 there is also shown the case where the down-regulating tilt moments due to the mass moments of inertia/moments of deviation of the tilt plate or tilt plate component group are so dimensioned that there results a regulation behaviour in which, in the event of an increase in the speed of rotation, the tilt angle of the tilt plate remains almost constant, or decreases, in which case, as a result, at least part of the increasing delivery output resulting from the increase in the speed of rotation is compensated.

The graph in FIG. 4 is based on the following calculation:

| Determination of swash plate tilt moment | | | | | | | | | |
|---|---|---|---|---|---|---|---|---|---|
| theta | 0 | 0.00 | [*] | | | | | | |
| n (p) | 7 | | — | beta | i | | | Jz | 297897 |
| R | 29 | | [mm] | beta | 1 | 0.0 | 0.00 | | |
| n | 2500 | | [1/min] | beta | 2 | 21.4 | 0.90 | (Jx =) Jy | 154552 |
| alpha | 16 | 0.28 | [*] | beta | 3 | 102.9 | 1.80 | | |
| mk | 45 | | [g] | beta | 4 | 154.3 | 2.69 | Jyz | 37981 |
| mk,ges | 315 | | [g] | beta | 5 | 205.7 | 3.59 | | |
| | | | | beta | 6 | 257.1 | 4.49 | omega | 262 |
| msw | 329 | | [g] | beta | 7 | 308.6 | 5.39 | | |
| ra | 37 | | [mm] | | | | | | |
| ri | 21 | | [mm] | | | | | | |
| h | 14.292 | | [mm] | z" | i | | | Jy/mk,ges | 491 |
| | | | | z" | 1 | 569.9 | | | |
| rho | 7.9 | | [g/cm³] | z" | 2 | 355.4 | | Jy/msw | 470 |
| | | | | z" | 3 | −126.8 | | | |
| | | | | z" | 4 | −513.5 | | Jz/mk,ges | 946 |
| | | | | z" | 5 | −513.5 | | | |
| | | | | z" | 6 | −126.8 | | Jz/msw | 905 |
| V | 41667 | | [mm³] | z" | 7 | 355.4 | | | |
| | | | | | | | | msw/mk,ges | 1.04 |
| | | | | Fmi | i | | | | |
| R fr,eing | 30 | | | Fmi | 1 | 25.6 | | | |
| R f(ra;ri) | 29 | | | Fmi | 2 | 16.0 | | | |
| | | | | Fmi | 3 | −5.7 | | | |
| | | | | Fmi | 4 | −23.1 | | | |
| | | | | Fmi | 5 | −23.1 | | | |
| sin2(alpha | 0.5299 | | | Fmi | 6 | −5.7 | | | |
| tan(alpha) | 0.2867 | | | Fmi | 7 | 16.0 | | | |
| | | | | M(Fmi) | i | | | | |
| | | | | M(Fmi) | 1 | 0.74 | | | |
| | | | | M(Fmi) | 2 | 0.29 | | | |
| | | | | M(Fmi) | 3 | 0.04 | | | |

-continued

| Determination of swash plate tilt moment | | | | | | | |
|---|---|---|---|---|---|---|---|
| | | | M(Fmi) | 4 | 0.60 | | |
| | | | M(Fmi) | 5 | 0.60 | | |
| | | | M(Fmi) | 6 | 0.04 | | |
| | | | M(Fmi) | 7 | 0.29 | | |
| n | 2500 | [1/min] | Mk,ges | 2.6032 | | Msw | 2.6032 |
| alpha | 16 | [*] | | | | | |
| n | 2500 | [1/min] | Mk,ges | 0.1585 | | Msw | 0.1714 |
| alpha | 1 | [*] | | | | | |
| n | 2500 | [1/min] | Mk,ges | 1.2759 | | Msw | 1.3540 |
| alpha | 8 | [*] | | | | | |
| n | 2500 | [1/min] | Mk,ges | 2.6032 | | Msw | 2.6032 |
| alpha | 16 | [*] | | | | | |
| n | 1100 | [1/min] | Mk,ges | 3.0679 | | Msw | 3.3191 |
| alpha | 1 | [*] | | | | | |
| n | 11000 | [1/min] | Mk,ges | 24.7014 | | Msw | 26.2141 |
| alpha | 8 | [*] | | | | | |
| n | 11000 | [1/min] | Mk,ges | 50.3983 | | Msw | 50.3972 |
| alpha | 16 | [*] | | | | | |

FIGS. 5, 6 and 7 show the tilt moments $M_{SW}$, $M_{k,ges}$ corresponding to FIGS. 1, 2 and 4 and also the sums of the two afore-mentioned moments for a speed of rotation in dependence on the tilt angle of the tilt plate or geometric stroke displacement volume of the compressor. In FIG. 5 the up-regulating characteristic of the compressor can be clearly seen by virtue of the sum of the moments being in the positive region, whereas in FIG. 6 the sum of the moments is negative for all tilt angles of the swash plate. A compressor which follows the plot of the moments according to FIG. 6 has a down-regulating characteristic. Lastly, reference may be made to FIG. 7, which shows a moment plot where the moments $M_{k,ges}$ and $M_{SW}$ are approximately equal so that the sum of moments for all tilt angles of the swash plate is approximately zero.

FIG. 8*a* gives the sum of $M_{SW}+M_{k,ges}$ for various speeds of rotation. FIG. 8*a* corresponds to FIGS. 1 and 5 and clearly shows an up-regulating total moment which Increases as the speed of rotation increases.

FIG. 8*b* shows the afore-mentioned sum for the case dealt with in FIGS. 2 and 6; it can be clearly seen that an increasingly down-regulating moment is obtained as the speed of rotation increases.

It should be pointed out that, in the case of FIGS. 8*a* and 8*b*, the moment of deviation of the tilt plate is equal to zero at the tilt angle 0°. This means that, in this example, the tilt-providing articulation and the mass centre of gravity of the swash plate coincide, in which case there is no outwardly displaced location of centre of gravity.

The diagram in FIG. 8*c* shows the behaviour of a compressor in which the moment of deviation and the resulting tilt moment $M_{SW}+M_{k,ges}$ at a swash plate tilt angle of 0° is not equal to zero. This results in start-up of the compressor being assisted by a moment; however, the following problems occur: As a result of the fact that at a very small tilt angle of, for example, 0° $M_{SW}$ $M_{k,ges}$ is already not equal to zero, the said amount continues to be present throughout the tilt angle range. The plot is accordingly shifted approximately parallel to a plot having a starting value where $M_{SW}+M_{k,ges}$ is equal to zero. It also has to be taken into account that, in the region of relatively large tilt angles, the up-regulating effect is increased by the additional tilt moment (cf. FIG. 8*a* in this respect). As the trend in the case of modern compressors is towards regulation behaviour which rather follows the plots of FIGS. 2 and 6 and/or 4 and 7, up-regulating behaviour in the region of relatively large tilt angles is undesirable.

BRIEF SUMMARY OF THE INVENTION

The problem of the present invention is to provide a compressor in which the excursion of the swash plate out from a region of small tilt angles is assisted in a manner that is as simple as possible.

In accordance with the invention, the problem is solved by the characterising features of claim 1, with advantageous developments and details of arrangements of the invention being described in the subordinate claims.

A fundamental aspect of the invention lies in providing the tilt plate or a tiltable part thereof with locations of reduced amassing of material and/or locations which consist of a material which is different from the material from which the rest of the tilt plate or tiltable part thereof is made. Those locations bring about a specific effect on the regulation behaviour of the tilt plate or compressor, more specifically in such a way that in a region of small tilt angles of the tilt plate or tiltable part thereof, especially in a tilt angle range from 0° to 8°, especially 0° to 3°, an advancing moment of the tilt plate is achieved such that the tilt moment of the tilt plate in the afore-mentioned tilt angle range is increased compared to a conventional tilt plate, especially compared to a tilt plate according to the prior art, and tilting of the tilt plate or the tiltable part thereof which up-regulates the compressor is promoted. As a result of a structural measure of such a kind it is possible to assist the tilting of the tilt plate at small tilt angles, when the compressor requires up-regulation. In the case of compressors without a coupling, a particular minimum piston displacement, which is required in the case of compressors according to the prior art in order to provide on the high-pressure side a pressure which is sufficient for up-regulation of the compressor, can be reduced or can become entirely superfluous. In the case of compressors where a speed of rotation is not permanently applied, that is to say which are connected to a drive via a coupling, an arrangement of such a kind facilitates start-up of the compressor or makes it possible for the first time.

In a preferred embodiment, the tilt plate is ring-shaped, that is to say is in the form of a tilt ring. The geometry of a tilt ring is especially well suited to providing locations of reduced amassing of material and/or locations made from another material. If a compressor has a swash plate, this swash plate is so dimensioned, for a predetermined desired or required mass moment of inertia, that it is narrower than a tilt ring which has the same predetermined mass moment of inertia. Consequently, the structural measures described in greater detail hereinbefore can be implemented on a tilt ring in especially simple manner. Furthermore, when the tilt plate is in the form of a tilt ring it can be ensured in simple manner that the stability and/or strength of the tilt plate is only insubstantially impaired, or not at all impaired, by the structural measures as a result of the locations of reduced amassing of material and/or locations where the tilt plate or the tiltable part thereof consists of a material which is different from the rest of the tilt plate or tiltable part thereof. This ensures a long service life for the compressor according to the invention, because a tilt plate constructed in such a manner is subject to little wear.

The locations of reduced amassing of material include, preferably, bores and additionally or, however, alternatively grooves. These are features which can be implemented by structurally simple means.

In a further preferred embodiment, the material of the locations which consist of a material which is different from the material from which substantially the rest of the tilt plate or tiltable part thereof is made has a lower density than the material from which substantially the rest of the tilt plate or tiltable part thereof is made. The afore-mentioned material of lower density preferably has a density which is less than about 7.83 g/cm$^3$ (density of steel), with preference being given to selection of a material having a density of about 1.5 g/cm$^3$. As a result of the lower density of the material of the locations which are made from a material which is different from the material from which substantially the rest of the tilt plate or tiltable part thereof is made, firstly the desired regulation behaviour is promoted, whilst the stability of the tilt ring or tilt plate is not diminished. An arrangement which is especially simple to produce has locations of plastics materials; the density of plastics materials is in the region of the order of magnitude of about 1.5 g/cm$^3$.

In a further preferred embodiment, the moment of deviation of the tilt plate or tiltable part thereof is equal to zero for a predetermined tilt angle in the region of small tilt angles, especially a tilt angle in the tilt angle range from 0° to 8°, especially 0° to 3°. Optionally, the moment of deviation of the tilt plate or tiltable part thereof promotes down-regulation of the compressor at tilt angles which are greater than the predetermined tilt angle, whereas for angles less than the angle for which the moment of deviation is zero the afore-mentioned moment of deviation assists up-regulation of the compressor. Regulation behaviour of such a kind corresponds to the demands made of a modern axial piston compressor, especially when used in the air-conditioning system of a motor vehicle.

In a further preferred embodiment, the centre of gravity of the tilt plate having, as described in greater detail hereinbefore, locations of reduced amassing of material and/or locations which are made from a material different to the rest of the tilt plate does not differ noticeably from the centre of gravity of a tilt plate which is made of one material and/or without locations of reduced amassing of material, that is to say of continuously solid construction. Furthermore, the centre of gravity of the tilt plate is located on a tilt axis associated with the tilt plate. This ensures that a compressor according to the invention has a high degree of quietness in running.

The tilt plate is preferably made of cast material, which makes it possible to produce the tilt plate by simple means. Grey cast iron (GG), spheroidal graphite cast iron (GGG), cast steel or cast aluminium are used especially. In a further preferred embodiment, at least some of the locations of reduced amassing of material, for example grooves, are formed in the course of casting of the tilt plate. As a result, the locations of reduced amassing of material can already be produced by simple means in the course of producing the tilt plate. In a further preferred embodiment, at least some of the locations of reduced amassing of material are formed by machining. Machining (in addition to or as an alternative to casting) ensures necessary fine-tuning of the tilt plate. Even though machining constitutes increased processing work compared to casting, good results can be achieved especially in the case of a high requisite precision. Furthermore, as already mentioned, a combination of casting and subsequent machining is feasible, especially in order to obtain requisite fine-tuning and counterbalancing of the tilt plate.

In a further preferred embodiment, the locations of reduced amassing of material and/or the locations which are made from a material which is different from the rest of the tilt plate or tiltable part thereof are arranged symmetrically with respect to one another. A special position is occupied by an arrangement of the locations in question having point symmetry with respect to the tilt-providing articulation. This structural measure also ensures that the tilt plate runs true. Imbalances and wear-promoting running can be avoided.

Preferably, the mean radius and/or mean height of the tilt plate or tiltable part thereof are so dimensioned that, in the region of medium and large tilt angles, that is to say especially in the region of tilt angles which are larger than the or a predetermined tilt angle for which the moment of deviation of the tilt plate is zero, centrifugal forces, which occur on rotation of the tilt plate and which oppose the tilt movement of the tilt plate, exceed forces applied to the tilt plate by the pistons and causing a further tilt movement, so that as the speed of rotation increases the piston displacement is reduced by an extent such that an approximately constant delivery quantity is established. This structural measure is, as mentioned, so carried out that it becomes effective in the region of medium and large tilt angles of the tilt plate whereas at very small and small tilt angles, that is to say approximately in a range up to 8°, more precisely up to the point where the moment of deviation in dependence on the tilt angle passes through zero, a tendency of the tilt plate to assist up-regulation can be observed.

As a result, the regulation characteristic of a compressor according to the invention meets the requirements for a modern compressor as is used in air-conditioning systems of motor vehicles.

Preferably, the centre of gravity of the tilt plate or tiltable part thereof is located on or at least close to the axis of the drive shaft, where there is especially also located the centre of a tilt-providing articulation associated therewith or the tilt axis thereof. As a result thereof, a high degree of quietness in the running of a compressor according to the invention is again achieved without an imbalance occurring.

When the tilt plate is in the form a tilt ring, preference is given to selecting both the internal diameter and the external diameter maximally within the external conditions. The external conditions in that context can be, for example, the internal diameter of the drive mechanism chamber, sufficient support for sliding blocks of an articulated arrangement between the pistons and tilt plate, or similar limiting or determining factors. It should be pointed out at this juncture that, in all the preceding embodiments, the desired regulation behaviour of the compressor is primarily achieved not by means of the component mass but rather by taking into account or utilising the mass moment of inertia of the tilt plate arrangement, which is dependent on the geometry of the latter. In the preferred exemplary embodiment now being discussed, in which the radii of the tilt ring or the diameters of the tilt ring are each selected maximally, a tilt plate geometry is made available which ensures a combination of low component mass and (sufficiently) large mass moments of inertia. The desired mass moment of inertia can also be influenced by suitably selecting the thickness of the tilt plate.

The tilt plate or tiltable part thereof is preferably made from two or more different materials governing the mean radius for the calculation of the mass moment of inertia, the different materials being separated from one another radially and/or axially. This is especially the case in that, in the case of a tilt ring, an outer or inner ring part is made from a first material, for example a material of relatively high density such as lead or the like, within an outer or inner circumferential groove in an inner or outer ring part, which is made from relatively hard and wear-resistant material such as, for example, steel, ceramic or the like. By that means, on the one hand, the mass moment of inertia of the compressor according to the invention can be optimised and, on the other hand, the incorporation of locations of reduced amassing of material and/or locations of a different material can be accomplished in relatively simple manner. This is especially the case when the outer ring is made from lead, because this constitutes a soft, easily worked material. When the tilt plate or tiltable part thereof is made from a plurality of materials of different density, the radially outer parts are preferably made from relatively dense material, whereas the radially inner parts are made from a less dense material. This structural measure too ensures optimum distribution of the mass moment of inertia of the tilt plate.

BRIEF DESCRIPTION OF THE DRAWINGS

The invention will be described hereinbelow with regard to further advantages and features by way of example and with reference to the accompanying drawings. The drawings show in.

DETAILED DESCRIPTION OF THE INVENTION

The compressor according to the invention comprises, for both preferred embodiments to be described in greater detail hereinbelow, a drive mechanism housing which is pot-shaped and the peripheral edge of which is adjacent to a cylinder block. Within the cylinder block there are arranged a plurality of, preferably five, six or seven pistons moving axially back and forth, the distribution of the pistons around the mid-axis of the housing being uniform. Through the base of the pot-shaped housing and into the interior of the housing or, that is to say, a drive mechanism chamber there extends a drive shaft, which is driven by way of a belt pulley. The drive shaft is mounted, on the one hand, in the region of the base of the pot-shaped housing and, on the other hand, within the cylinder block. Acting within the drive mechanism chamber is a tilt plate mechanism, which comprises, inter alia, a tilt ring, by means of which the rotary movement of the drive shaft is converted into axial movement of the pistons. Furthermore, inlet and outlet valves are arranged between a cylinder head and the cylinder block. The above structure is by and large known from the relevant prior art.

Figure 1:
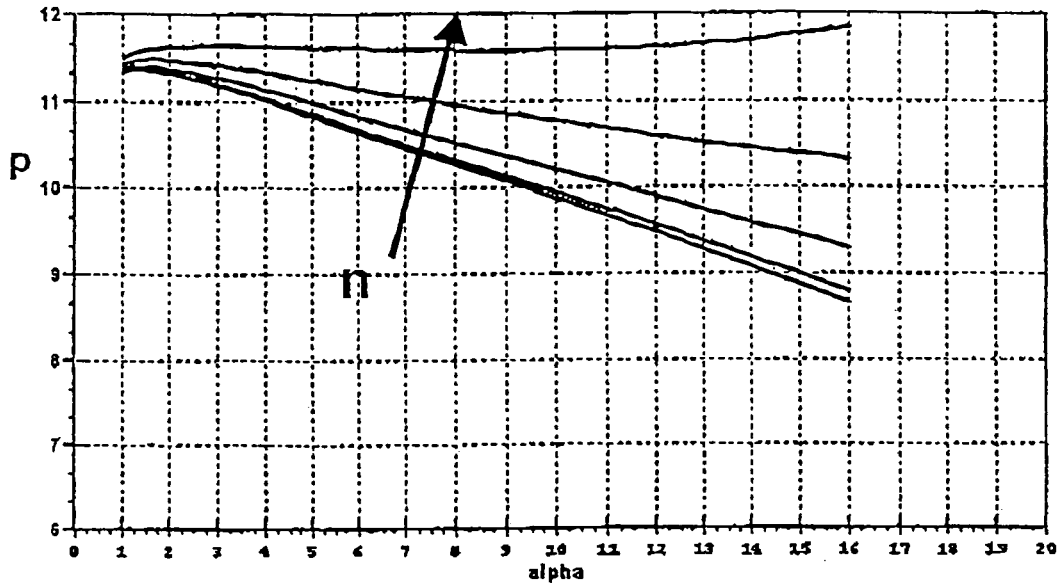
FIG. 1 shows the dependence of drive mechanism chamber pressure difference, relative to the suction pressure, set against the tilt angle [alpha], or "alpha", of the tilt plate.
Figure 2:
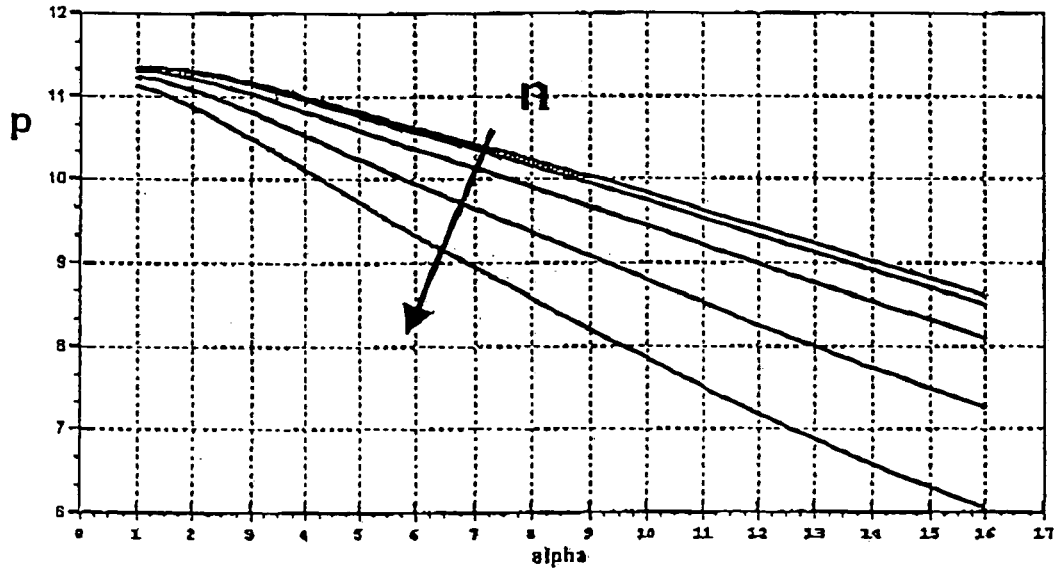
FIG. 2 shows a diagram for an almost identical drive mechanism, which diagram results from the following calculation scheme, [alpha] being varied from 0[deg.] to 16[deg.].
Figure 3:
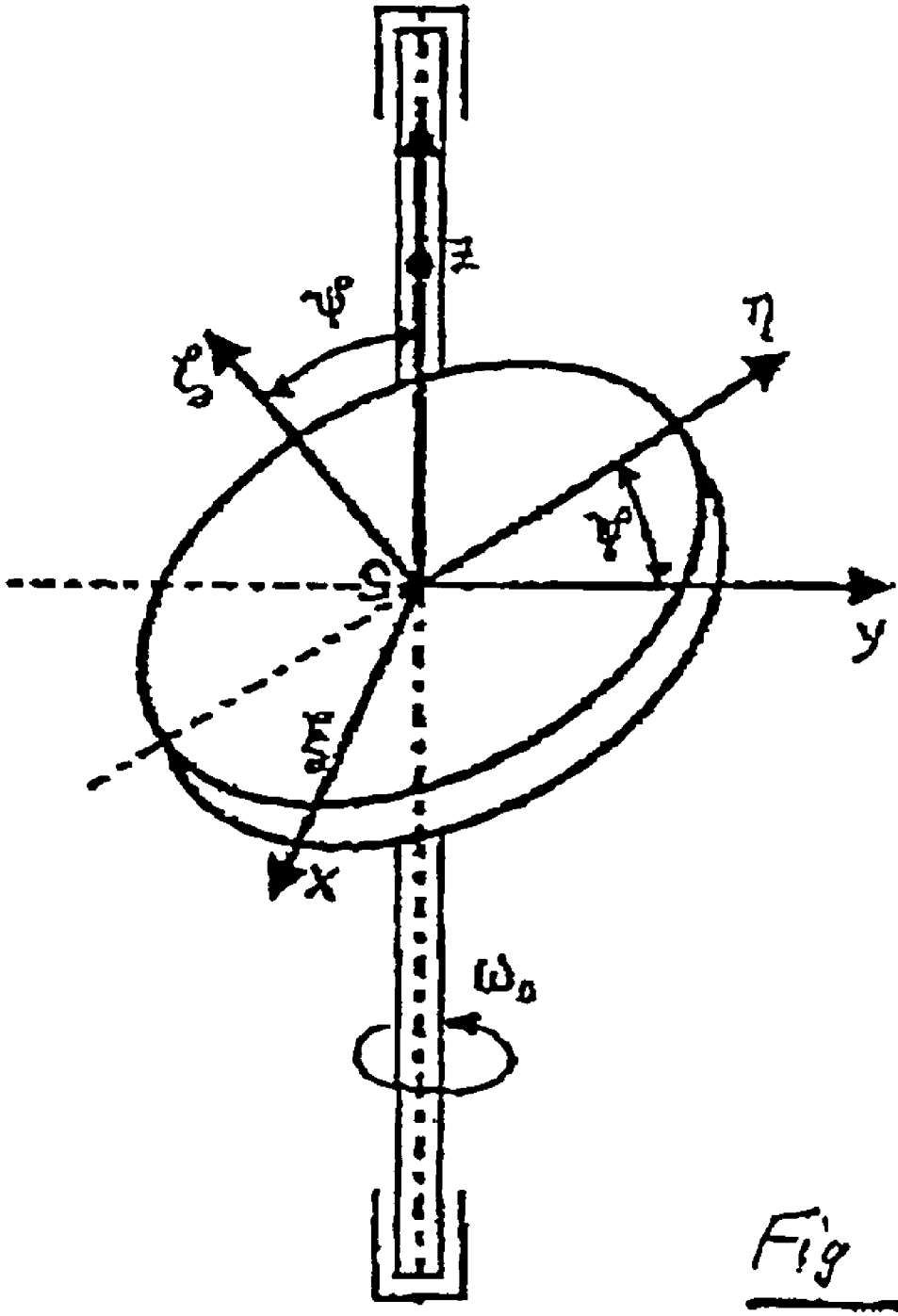
FIG. 3 shows the derivation of the movement of deviation for the tilting of the tilt plate or tilt ring.
Figure 4:
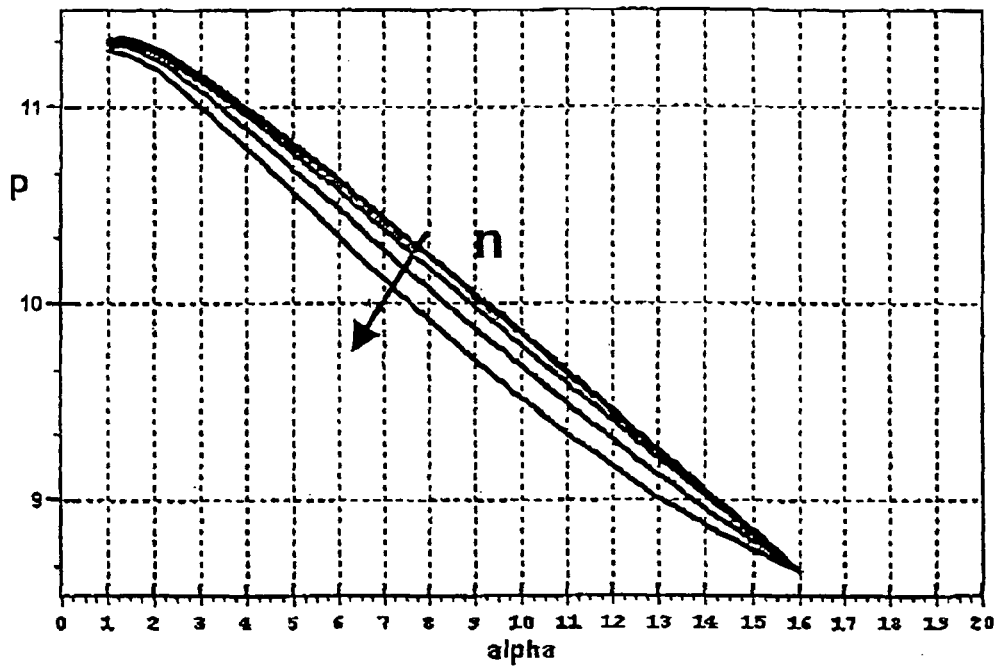
FIG. 4 shows a graph of at least a part of the increasing delivery output resulting from the increase in the speed of rotation is compensated.
Figure 5:
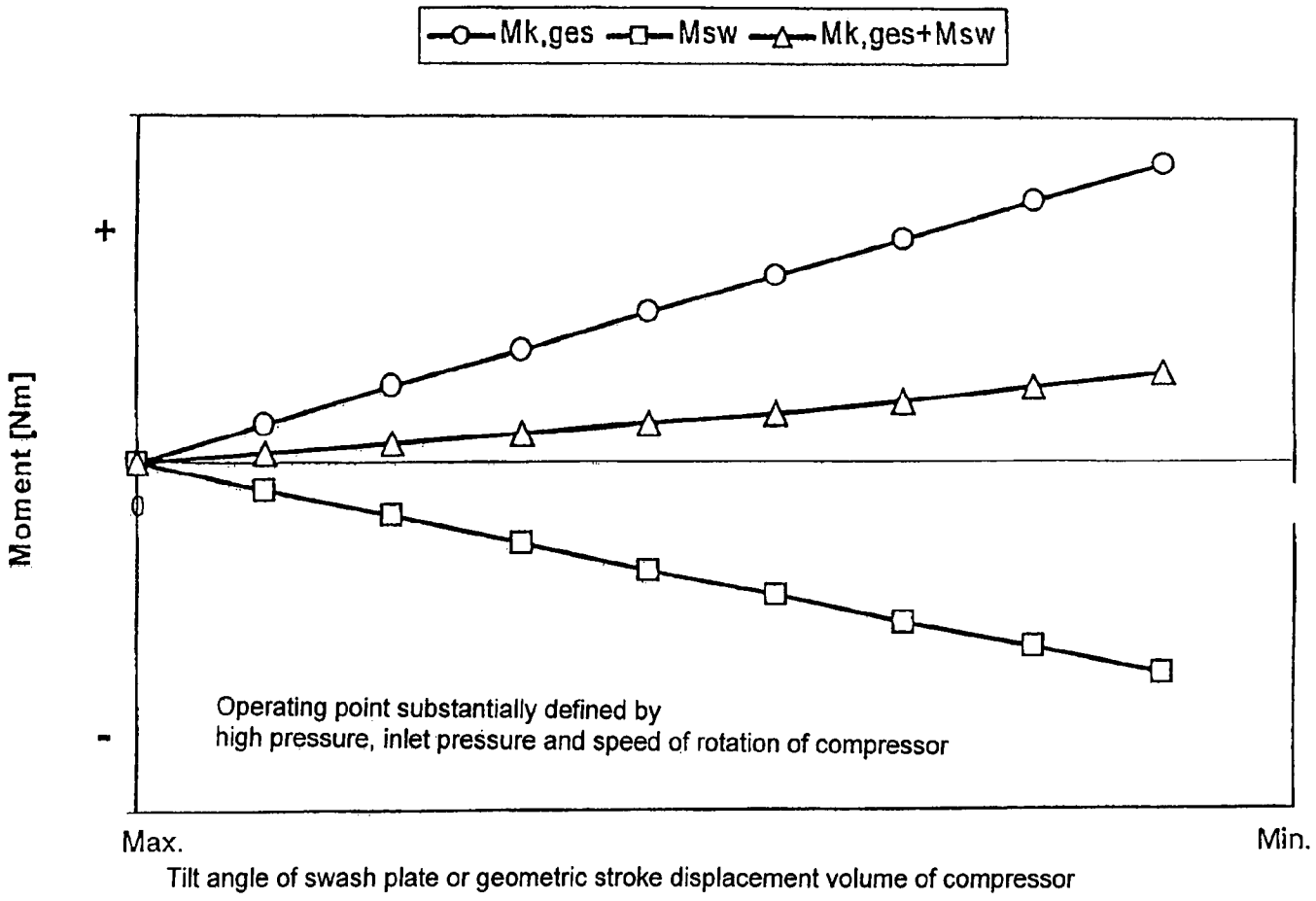
FIGS. 5, 6 and 7 show the tilt moments $M_{SW}$, $M_{k,ges}$ corresponding to FIGS. 1, 2 and 4 and also the sums of the two moments for a speed of rotation in dependence on the tilt angle of the tilt plate or geometric stroke displacement volume of the compressor.
Figure 6:
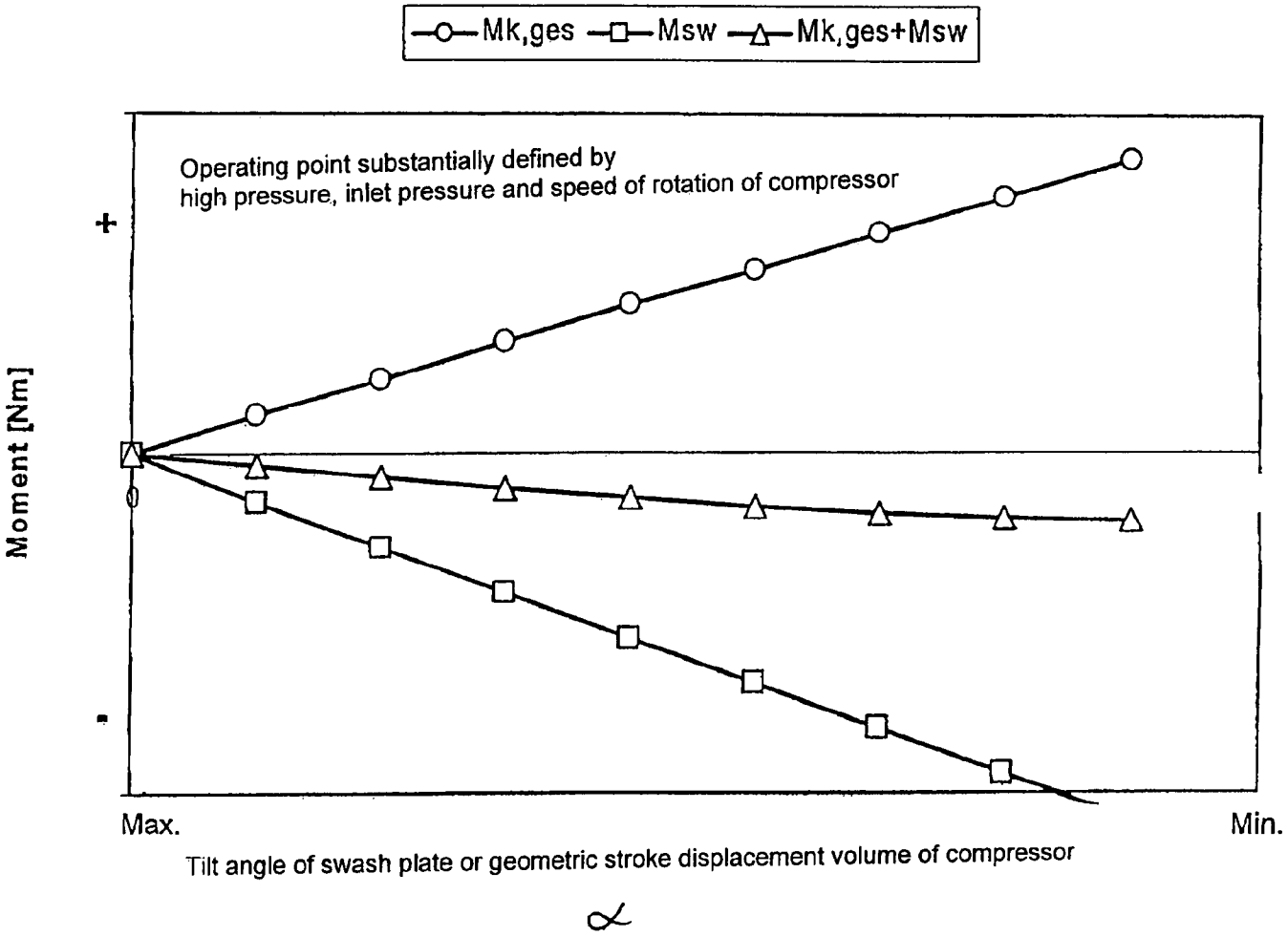
Figure 7:
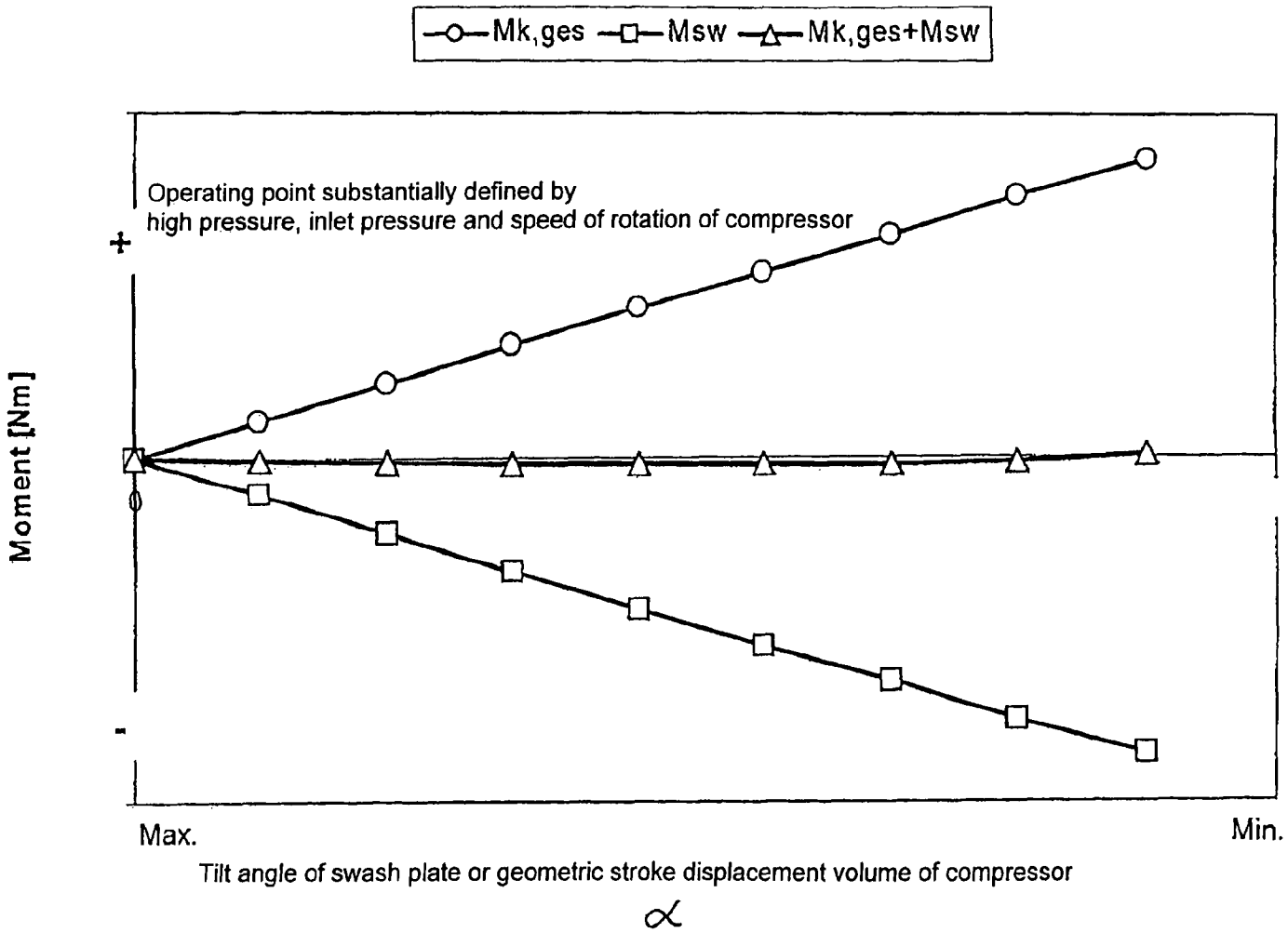
Figure 8A:
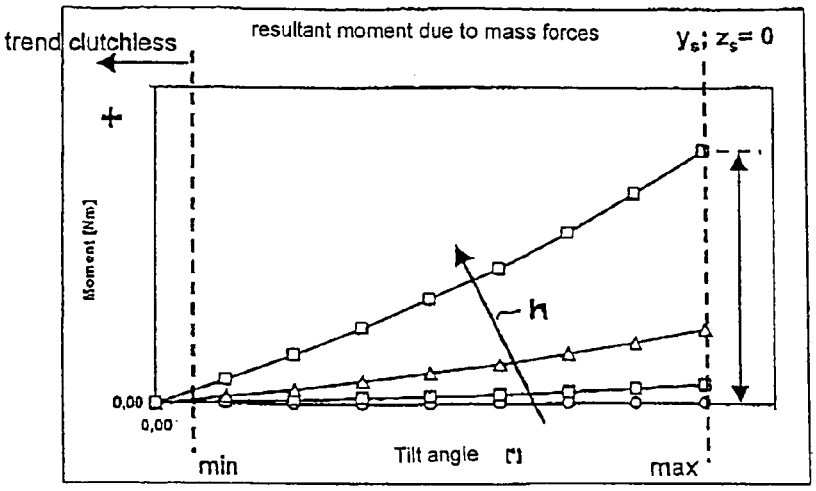
FIG. 8*a* gives the sum of $M_{SW}+M_{k,ges}$ for various speeds of rotation.
Figure 8B:
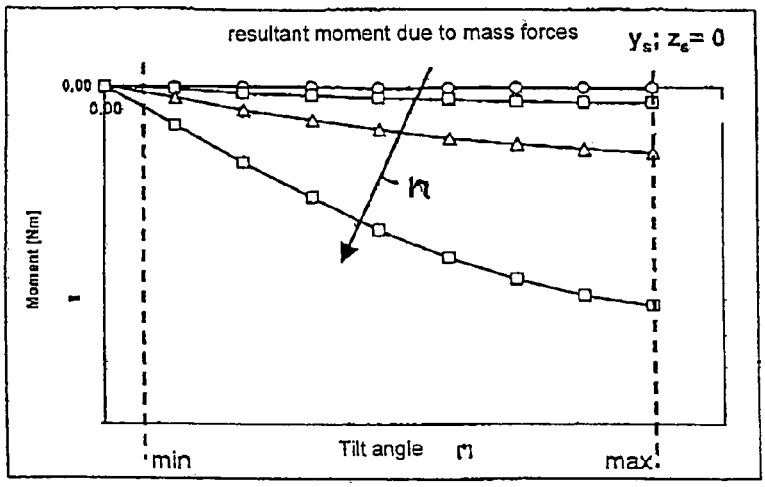
FIG. 8*b* shows the sum for the case dealt within FIGS. 2 and 6.
Figure 8C:
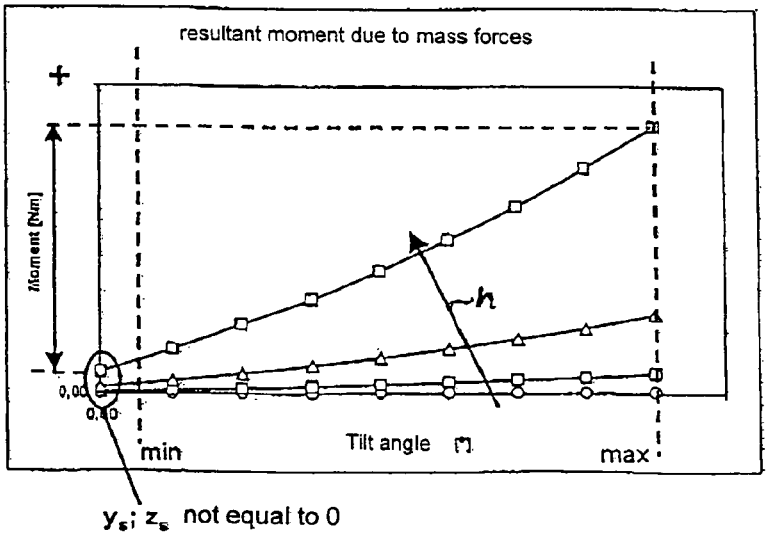
FIG. 8*c* shows the behavior of a compressor in which the moment of deviation and the resulting tilt movement $M_{SW}$, $M_{k,ges}$ at a swash plate tilt angle of 0[deg.] is not equal to zero.
Figures 9A, 9B:
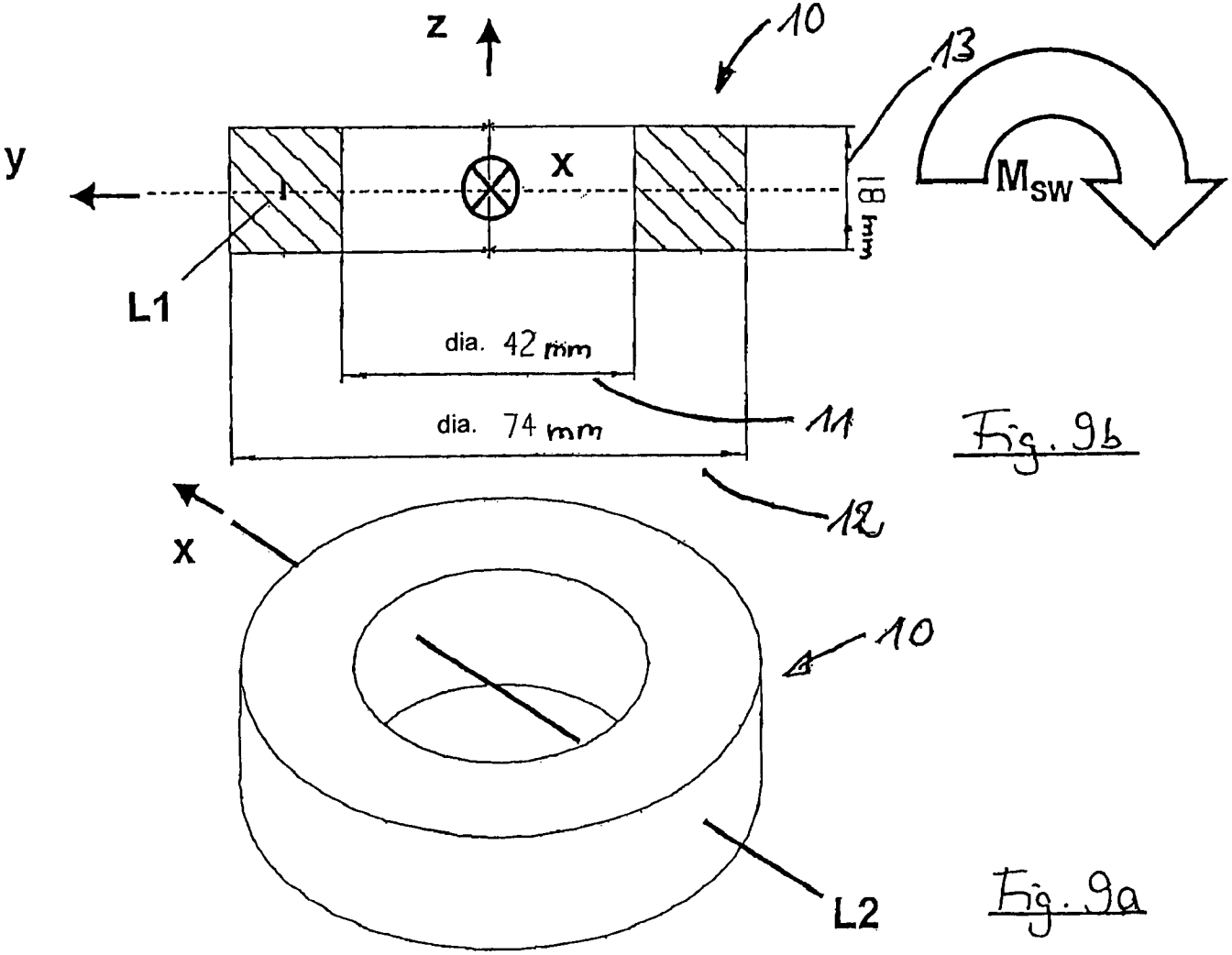
FIG. 9*a* shows a "blank" for a tilt ring for a compressor according to the invention, that is to say an as yet unfinished tilt ring, in an oblique perspective view.
FIG. 9*b* shows the tilt ring of FIG. 9*a* in a sectional view.

An example of the tilt plate in the form of a tilt ring 10 which forms the basis of the two preferred embodiments of the present invention is shown in FIG. 9*a* and FIG. 9*b* in the form of a "blank" which is not to be found in that form in a compressor according to the invention; however, by means of a "simplified" representation of such a kind it is possible to make explanations of principles by simple means. Furthermore, a comparison will be made hereinbelow of the moments of deviation of compressors according to the invention with that of a tilt ring according to FIGS. 9*a* and 9*b* in order to be able to illustrate the advantages of an arrangement according to the invention.

The tilt ring forming the common basis for the two embodiments is made from cast material and has an internal diameter 11 of 42 mm and an external diameter 12 of 74 mm with a height 13 of 18 mm. It should be pointed out at this juncture that the above-mentioned dimensions are on no account to be interpreted in limiting manner but rather they merely give an example of the dimensions of a tilt ring of such a kind. The afore-mentioned variables accordingly serve mainly to orient the reader rather than to limit a compressor according to the invention to particular dimensions. The inventive concept itself is of course independent of any dimensions of the compressor.

Figure 10B:
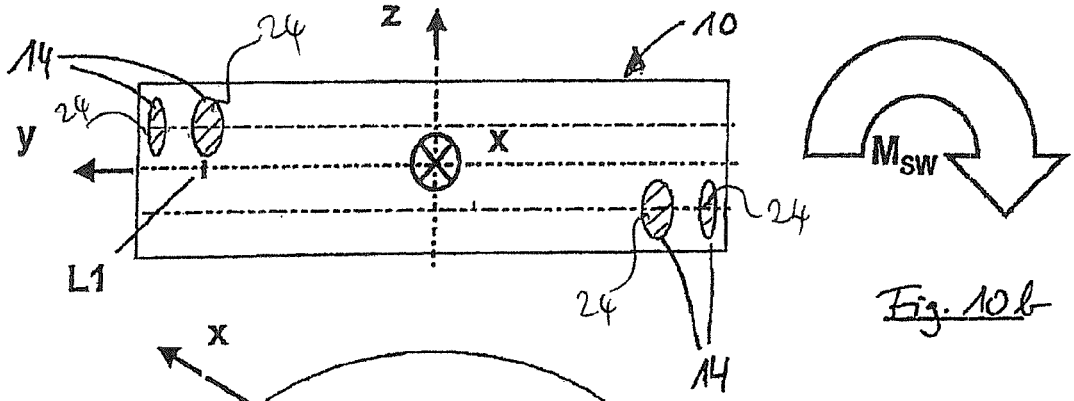
FIG. 10*b* shows the tilt ring of FIG. 10*a* in a sectional view.
Figure 10A:
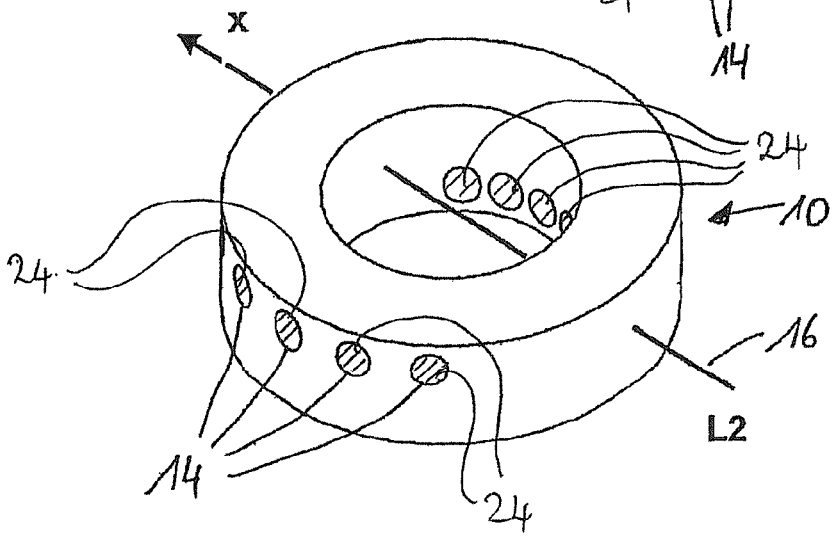
FIG. 10*a* shows a first arrangement of a tilt ring for a compressor according to the invention, in an oblique perspective view.

In order to obtain a moment of deviation of the tilt plate which, at a tilt angle of 0.degree., is not equal to zero and which, at a predetermined tilt angle not equal to 0.degree., is equal to zero, there are provided, in the respective tilt rings in the two preferred embodiments of a compressor according to the invention, locations of reduced amassing of material 24 and 25 which, in the first preferred exemplary embodiment according to FIGS. 10*a* and 10*b*, are in the form of bores 14 or bore-like, that is to say cylindrical, recesses. In the second preferred exemplary embodiment according to FIGS. 11*a* and 11*b*, the recesses are in the form of grooves 15.

As can be seen from FIGS. 10*a* and 10*b* and also 11*a* and 11*b*, the recesses are arranged symmetrically with respect to an x axis 16, in which case the centre of gravity of the tilt ring is not changed as a result of the recesses in the form of bores 14 and grooves 15 compared to the "blank" shown in FIGS. 9*a* and 9*b*. In each of the two preferred exemplary embodiments, the centre of gravity of the tilt ring 10 lies on the x axis 16, which at the same time constitutes a tilt axis associated with the respective tilt ring 10.

Because of the geometric dimensions, especially a relatively large height 13 for the tilt ring 10, the locations 14 and 15 of reduced amassing of material 24 and 25 do not impair either the stability or the strength of the tilt ring 10 when one compares the respective values therefor with those of the blank according to FIGS. 9*a* and 9*b*. The recesses according to FIGS. 10*a* to 11*b* are incorporated in the blank in the course of casting, the necessary fine-tuning, which ensures that the tilt ring runs without an imbalance, being carried out by means of (subsequent) machining.

The locations of reduced amassing of material 24 and 25 in the form of bores 14 or grooves 15 are provided in such a manner that, depending on the arrangement, the moment of deviation of the tilt ring—which results in a corresponding tilt moment for the tilt ring 10—has a point where it passes through zero which is at a tilt angle of about 1.degree. to about 2.degree. (also compare, in this respect, the diagram in FIG. 12, which will be explained in greater detail hereinbelow). For smaller tilt angles, the afore-mentioned moment of deviation promotes tilting of the tilt ring 10 in a direction which up-regulates the compressor, whereas for tilt angles greater than about 1.degree. to about 2.degree. the moment of deviation favors a down-regulating tendency of a compressor according to the invention. It should be noted at this juncture that the down-regulating tendency in particular can optionally be reinforced if so required by providing additional weights or else by constructing a tilt ring 10 of a compressor according to the invention using a plurality of materials. In this case it is especially to be recommended that the different materials are separated from one another radially and/or axially, more specifically in such a manner that an outer or inner ring part is made from a first material, preferably from a material of relatively high density such as lead or the like, within an outer or inner circumferential groove of an inner or outer ring part, which is made from relatively hard and wear-resistant material such as, for example, steel or ceramic or the like. In that case, the radially outer part is preferably made of denser material than the radially inner part.

Of course it is also feasible for the recesses in the form of bores or grooves and also, of course, recesses of any other shape for achieving the desired regulation behavior to be filled with a material preferably of relatively low density and accordingly to form locations which are made of a material 24 and 25 which is different from the material from which substantially the rest of the tilt ring is made. This measure serves to maintain the stability of the tilt ring, such an alternative being of interest also and especially for tilt plates in the form of swash plates because, in the case of swash plates in particular, it is not possible to incorporate excessively large recesses without impairing the stability of the swash plate. Furthermore, in the regions of reduced amassing of material, other measures maintaining the rigidity and/or strength of the tilt plate or tilt ring 10 such as braces or the like are, of course, also feasible.

It should also be noted at this juncture that the internal and external diameters are limited within the external conditions, in the present case by the internal diameter of the drive mechanism chamber, but are in each case selected maximally with respect thereto. The centre of gravity of the tilt ring 10 lies, within the scope of tolerances, on the axis of the drive shaft, which at the same time constitutes the centre of a tilt-providing articulation (not shown) and the associated tilt axis, which is identical to the x axis 16.

Figure 11A:
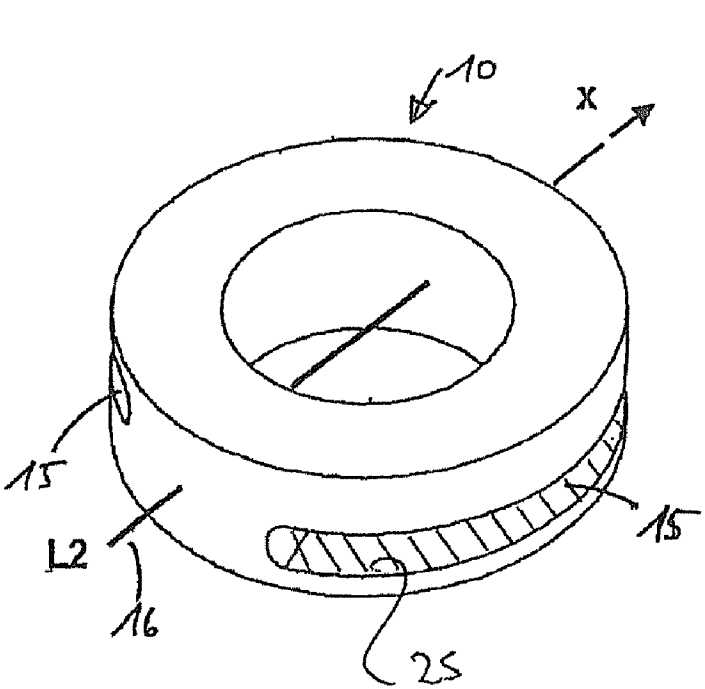
FIG. 11*a* shows a second arrangement of a tilt ring for a compressor according to the invention, in an oblique perspective view.
Figure 11B:
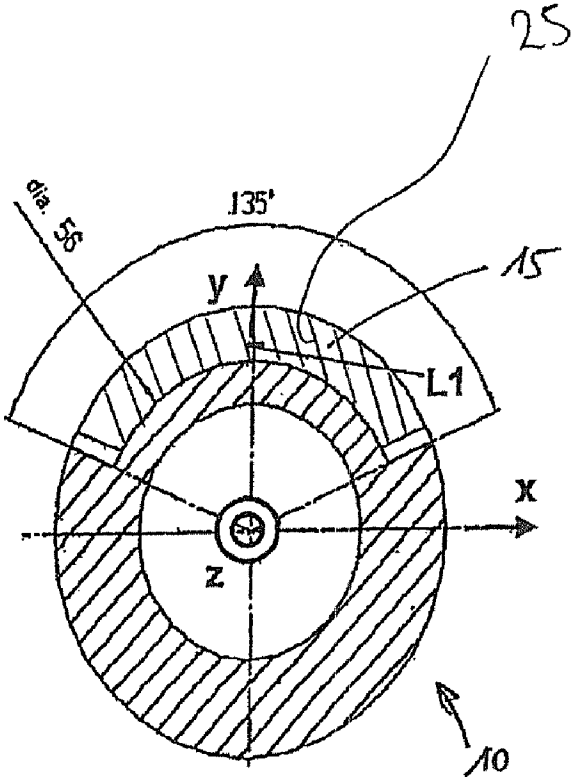
FIG. 11*b* shows the tilt ring of FIG. 11*a* in a sectional view.

As a result of the symmetrical distribution of the recesses with respect to the tilt axis, there is produced a moment of deviation which is not equal to zero at a tilt angle of 0°. Reference should be made here especially to the position of the particular recesses, which are provided on one side of the tilt axis closer to the upper edge of the tilt ring 10 and on the other side of the tilt axis closer to the lower edge of the tilt ring 10. The same is also true of recesses in the form of grooves 15, as shown in FIGS. 11*a* and 11*b*. It can also be seen from FIG. 11*b* that, in the case of the present preferred exemplary embodiment, the grooves extend over an angle of 135° and have a depth of 18 mm. The afore-mentioned values are also to be regarded as being purely illustrative and serve to orient the reader. They of course have no crucial influence on the basic inventive concept.

Figure 12:
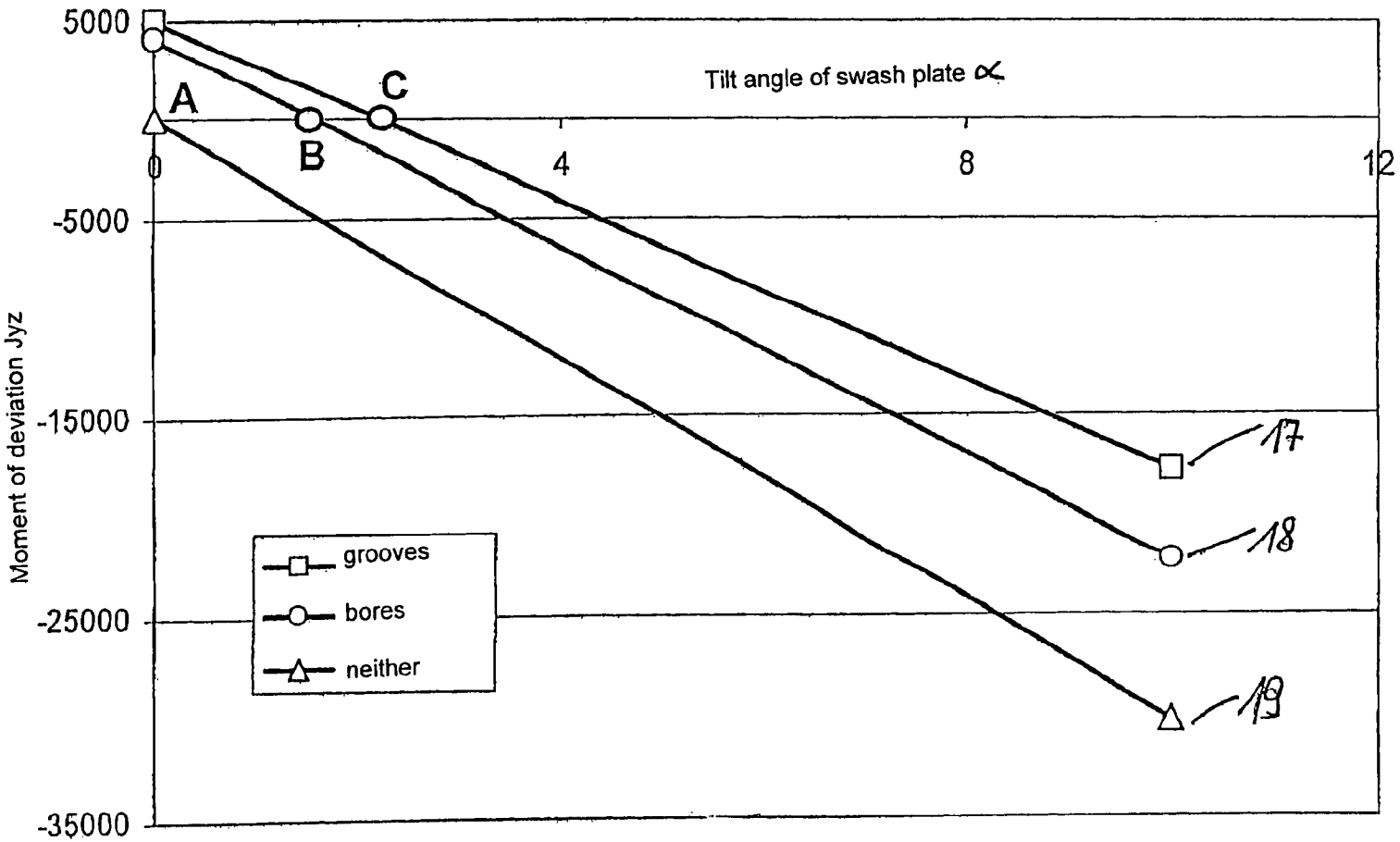
FIG. 12 shows a graph of the moment of deviation of the tilt rings according to FIGS. 9*a* to 11*b* in dependent on the tilt angle of the respective tilt rings.
Figure 13:
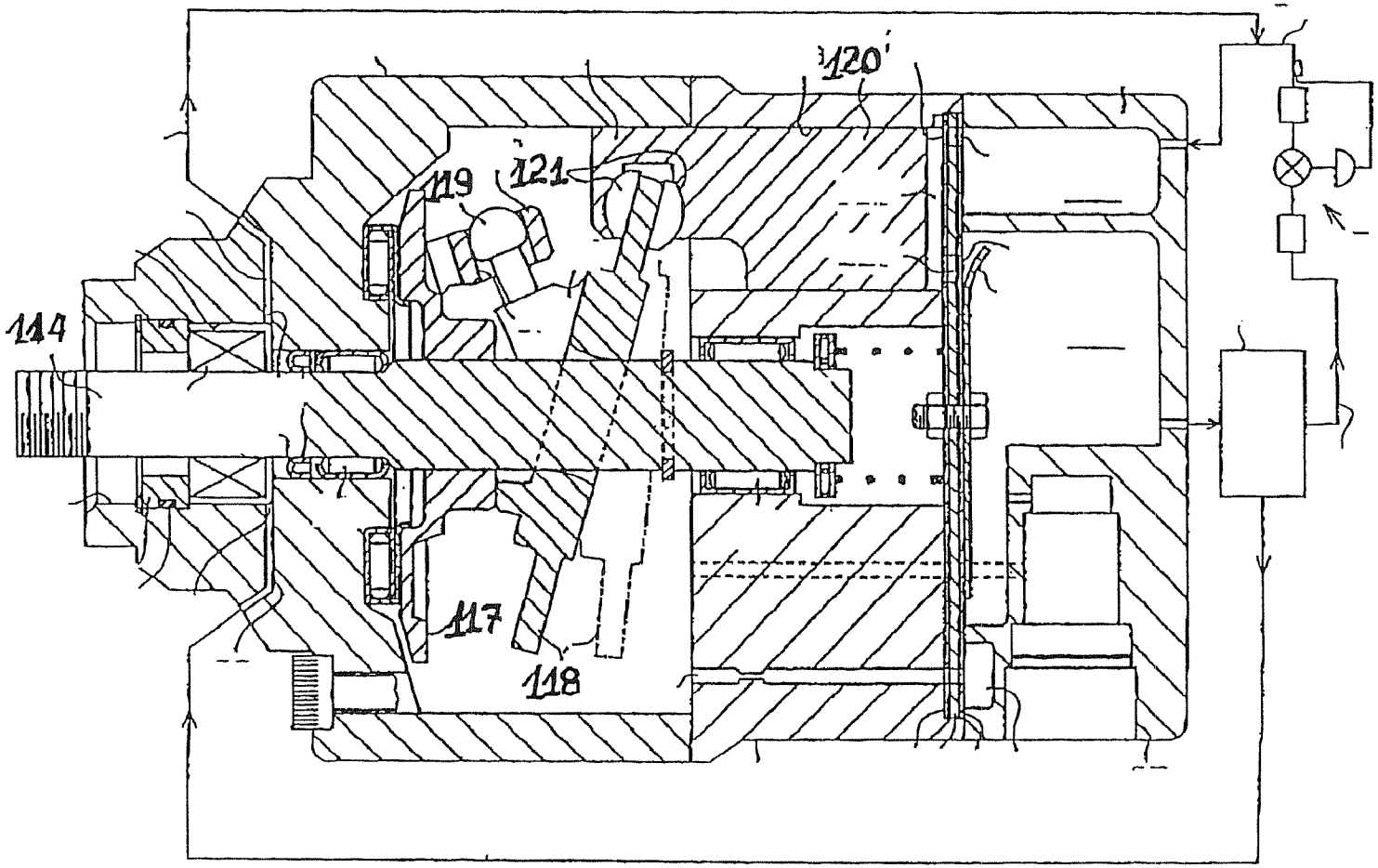
Fig-13 PRIOR ART
FIG. 13 shows a known compressor from EP1172557. The compressor has a pivoting disk device with a tilt plate in the form of a swash plate 118, and hinged to a piston 120 via sliding blocks 121. Further, the pivoting disk is arranged on a supporting device which transmits by means of an actuator a torque between a drive shaft 114 and the swash plate 118.

Finally in FIG. 12 there are shown the graphs of the moments of deviation $J_{yz}$ responsible for the tilt movement of the tilt ring 10 plotted against the tilt angle a of the tilt ring 10. In this Figure there are plotted a curve 17, which represents the behaviour of a tilt ring 10 having grooves 15, and a curve 18, which represents the behaviour of a tilt ring 10 having bores 14, beside a comparison curve 19, which represents the behaviour of a tilt ring without recesses, that is to say a tilt ring according to FIGS. 9*a* and 9*b*. As can be seen from the diagrams, the tilt ring without recesses has, over the entire tilt angle range, a moment of deviation which favours down-regulating behaviour of the tilt ring, whereas the two tilt rings 10 provided with recesses show a moment of deviation which has a point, in the region of a tilt angle of approximately 1° to about 2°, where it passes through zero. For smaller angles there is brought about an up-regulating regulation behaviour of the compressor, whereas for larger tilt angles of the tilt ring 10 a down-regulating behaviour is brought about. As a result, the requirements for a modern compressor are met. It should be noted that the plot of the moment of deviation in dependence on the tilt angle of the tilt plate 10 is almost linear, which ensures ideal regulation behaviour of a compressor according to the invention.

Although the invention is described using exemplary embodiments having fixed combinations of features, it nevertheless also encompasses any further feasible advantageous combinations of those features, as are especially but not exhaustively mentioned in the subordinate claims. All features disclosed in the application documents are claimed as being important to the invention insofar as they are novel on their own or in combination compared with the prior art.

LIST OF REFERENCE NUMBERS

10 tilt ring
11 internal diameter
12 external diameter
13 height

14 bore
15 groove
16 x axis
17 moment of deviation in dependence on tilt angle, with recesses in the form of grooves 15
18 moment of deviation in dependence on tilt angle, with recesses in the form of bores 14
19 moment of deviation in dependence on tilt angle, without recesses
24 material
25 material

The invention claimed is:

1. Axial piston compressor, especially a compressor for the air-conditioning system of a motor vehicle, having a housing and, for drawing in and compressing a coolant, a compressor unit arranged in the housing and driven by means of a drive shaft, the compressor unit comprising pistons, which move axially back and forth in a cylinder block, and a tilt plate (10), which drives the pistons and rotates together with the drive shaft, characterised in that the tilt plate (10) or a tiltable part thereof associated therewith has locations (14, 15) of reduced amassing of material (24, 25) and/or locations which consist of a material (24, 25) which is different from the material from which substantially the rest of the tilt plate (10) or tiltable part thereof is made, those locations bringing about a specific effect on the regulation behaviour of the tilt plate (10) in such a way that in a region of small tilt angles of the tilt plate (10) or tiltable part thereof, especially in a tilt angle range from 0° to 8°, an advancing moment of the tilt plate (10) is achieved such that the tilt moment of the tilt plate (10) in the afore-mentioned tilt angle range is increased compared to a tilt plate without the afore-mentioned locations, and the material of the locations which are made from a material which is different from the material from which substantially the rest of the tilt plate or tiltable part thereof is made has a lower density than the material from which substantially the rest of the tilt plate or tiltable part thereof is made.

2. Compressor according to claim 1, characterised in that the tilt plate is ring-shaped, that is to say in the form of a tilt ring (10).

3. Compressor according to claim 1, characterised in that the locations of reduced amassing of material comprise bores (14) and/or grooves (15).

4. Compressor according to claim 1, characterised in that the material of the locations which are made from a material which is different from the material from which substantially the rest of the tilt plate or tiltable part thereof is made has a density which is lower than about 7.83 g/cm3.

5. Compressor according to claim 1, characterised in that the moment of deviation of the tilt plate (10) or tiltable part thereof for a predetermined tilt angle in the region of small tilt angles, especially for a tilt angle in the tilt angle range from 0° to 8°, is equal to zero.

6. Compressor according to claim 5, characterised in that, at tilt angles which are greater than the predetermined tilt angle, the moment of deviation of the tilt plate or tiltable part thereof has a tilt-angle-reducing action, whereas for tilt angles which are lower than the predetermined tilt angle it has a tilt angle-increasing action.

7. Compressor according to claim 1, characterised in that the centre of gravity of the tilt plate (10) or tiltable part thereof, which has the locations of reduced amassing of material and/or the locations which are made from a material different to the rest of the tilt plate (10) or tiltable part thereof, does not differ from the centre of gravity of a tilt plate which is made of one material and/or without locations of reduced amassing of material, the centre of gravity of the tilt plate (10) or tiltable part thereof being located on a tilt axis (16) associated therewith.

8. Compressor according to claim 1, characterised in that the tilt plate (10) is made from cast material, grey cast iron (GG), spheroidal graphite cast iron (GGG), cast steel or cast aluminium.

9. Compressor according to claim 8, characterised in that at least some of the locations (14, 15) of reduced amassing of material are cast, that is to say are formed in the course of casting of the tilt plate (10).

10. Compressor according to claim 1, characterised in that at least some of the locations (14, 15) of reduced amassing of material are formed by machining and/or a requisite fine-tuning and counterbalancing of the tilt plate (10) or tiltable part thereof is achieved by machining.

11. Compressor according to claim 1, characterised in that the locations (14, 15) of reduced amassing of material and/or the locations which are made from a material different from the rest of the tilt plate are arranged symmetrically to one another with respect to the tilt providing articulation.

12. Compressor according to claim 1, characterised in that the mean radius and/or mean height of the tilt plate (10) or tiltable part thereof are so dimensioned that, at medium and large tilt angles, especially at tilt angles greater than 8° centrifugal forces, which occur on rotation of the tilt plate (10) and which oppose the tilt movement of the tilt plate (10), exceed forces applied to the tilt plate (10) by the pistons and causing a further tilt movement, so that as the speed of rotation increases the piston displacement is reduced by an extent such that an approximately constant delivery quantity is established.

13. Compressor according to claim 1, characterised in that the centre of gravity of the tilt plate (10) or tiltable part thereof is located on the axis of the drive shaft, where there is especially also located the centre of a tilt-providing articulation associated therewith or the tilt axis (16) thereof.

14. Compressor according to claim 1, characterised in that, when the tilt plate (10) is in the form a tilt ring, the internal diameter (11) and external diameter (12) are in each case selected maximally within the external conditions.

15. Compressor according to claim 1, characterised in that the tilt plate (10) or tiltable part thereof is made from two or more different materials governing the mean radius for the calculation of the mass moment of inertia, the different materials being separated from one another radially and/or axially, especially in such a manner that in the case of a tilt ring (10) an outer or inner ring part is made from a first material of relatively high density lead, within an outer or inner circumferential groove in an inner or outer ring part, which is made from relatively hard and wear-resistant material such as, for example, steel or ceramic.

16. Compressor according to claim 15, characterised in that, when the tilt plate (10) or tiltable part thereof is made from a plurality of materials of different density, the radially outer parts are made of denser material than the radially inner parts.

17. An axial piston compressor for the air-conditioning system of a motor vehicle, said compressor comprising:

a housing, a compressor unit arranged in said housing and operative to draw in and compress a coolant, a drive shaft operative to drive said compressor unit, said compressor unit comprising a cylinder block, pistons adapted to move axially back and forth in said cylinder block, and a tilt plate selected from the group consisting of a tilt ring, a wobble plate and a swash plate connected to rotate together with said drive shaft and operative to drive said pistons, wherein said tilt plate or a tiltable part thereof associated therewith has regulation behavior locations selected from the group consisting of locations of reduced amassing of material, locations which consist of a material which is different from the material from which substantially the rest of the tilt plate or tiltable part thereof is made, and locations of reduced amassing of material and locations which consist of a material which is different from the material from which substantially the rest of the tilt plate or tiltable part thereof is made, said regulation behavior locations bringing about a specific effect on the regulation behavior of said tilt plate in such a way that in a region of small tilt angles of the tilt plate or tiltable part thereof selected from the group consisting of 0° to 8°, an advancing moment of the tilt plate is achieved such that the tilt moment of the tilt plate in the aforementioned tilt angle range is increased compared to a tilt plate without the aforementioned regulation behavior locations and provides accelerated up-regulation of the compressor, and the material of the locations which are made from a material which is different from the material from which substantially the rest of the tilt plate or tiltable part thereof is made has a lower density than the material from which substantially the rest of the tilt plate or tiltable part thereof is made.

* * * * *